US007017797B2

(12) United States Patent
Goglio

(10) Patent No.: US 7,017,797 B2
(45) Date of Patent: Mar. 28, 2006

(54) CARDBOARD CONTAINER FOR SOLID, GRANULAR OR POSSIBLY PASTY PRODUCTS, AND MANUFACTURING METHOD THEREOF

(75) Inventor: Luigi Goglio, Milan (IT)

(73) Assignee: P.L.V. SpA, Milan (IT)

( * ) Notice: Subject to any disclaimer, the term of this patent is extended or adjusted under 35 U.S.C. 154(b) by 181 days.

(21) Appl. No.: 10/446,735

(22) Filed: May 29, 2003

(65) Prior Publication Data

US 2004/0238609 A1 Dec. 2, 2004

(51) Int. Cl.
*B65D 43/04* (2006.01)

(52) U.S. Cl. ..... 229/125.17; 229/125.05; 229/125.14; 229/5.5; 229/109; 229/240; 229/242

(58) Field of Classification Search ..... 229/125.17, 229/125.05, 125.14, 125.19, 5.5, 116.1, 109, 229/240, 242

See application file for complete search history.

(56) References Cited

U.S. PATENT DOCUMENTS 2,120,898 A * 6/1938 Arlington ..... 229/5.6
2,241,710 A * 5/1941 Lowey ..... 229/125.17
2,307,854 A * 1/1943 Palmer ..... 229/122.31
2,438,982 A * 4/1948 Williamson ..... 229/5.83
2,726,803 A * 12/1955 Ketler ..... 229/5.5
2,815,164 A * 12/1957 Painter ..... 229/109
2,847,151 A * 8/1958 Meyer-Jagenberg ... 229/125.05
2,970,736 A * 2/1961 Baughan ..... 229/123.1
3,124,295 A * 3/1964 Kauffeld ..... 229/211
4,632,298 A * 12/1986 Schellenberg ..... 229/5.5

* cited by examiner

*Primary Examiner*—T Mai
(74) *Attorney, Agent, or Firm*—Sughrue Mion, PLLC

(57) ABSTRACT

A cardboard container (1) is described particularly for solid, granular or powder products, but also adaptable to contain fluid products, in particular paste or cream products and the like. The container is obtained from two cardboard blanks (10), (11), the first giving rise to the body of the container, the second to a top closure wall. The body of the container rises conically from a rectangular base (2) to give rise at the top to a substantially octagonal mouth, wherein is inserted said reclosure cover (8) having peripheral flaps (h) upwardly folded and positioned inside the mouth of the container, to be blocked by corresponding flaps (f, f') of the upper edge (3) of the container (1), which are folded inwardly and fixed by means of glue or heat-sealing adhesive. In one embodiment, the container (1) can be made hermetic, for containing fluid products, by applying a film (40) to the blank wherefrom the body of the container is produced, and a thin layer of aluminium (50) to the blank (11) giving rise to said top closure wall (8), wherein a cut line (22, 23) is provided to facilitate removal of a disk (8') and form an opening for access to the product. A method for production of such a container is also described.

14 Claims, 6 Drawing Sheets

FIG. 4
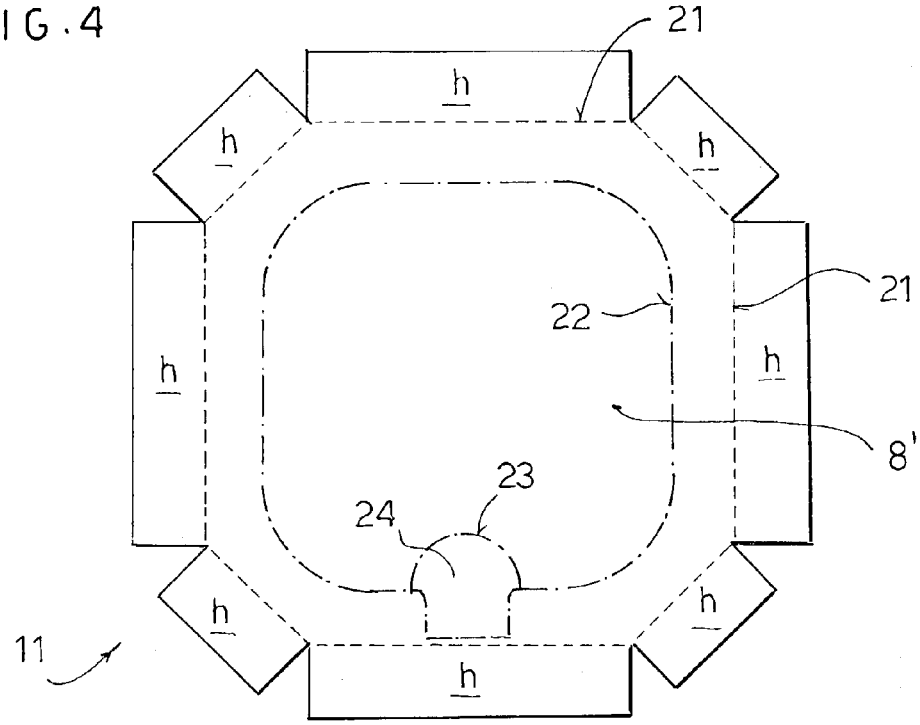
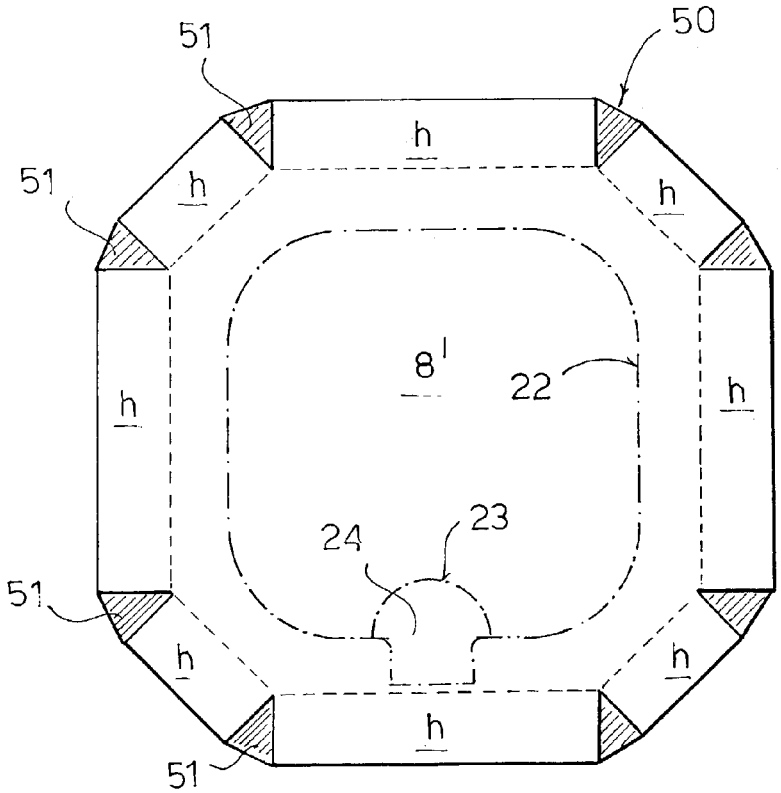
FIG. 9

FIG. 6
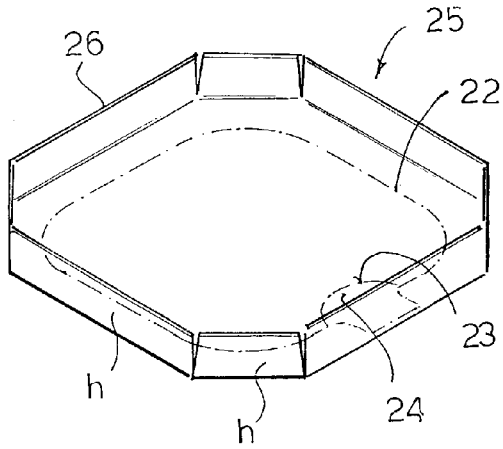
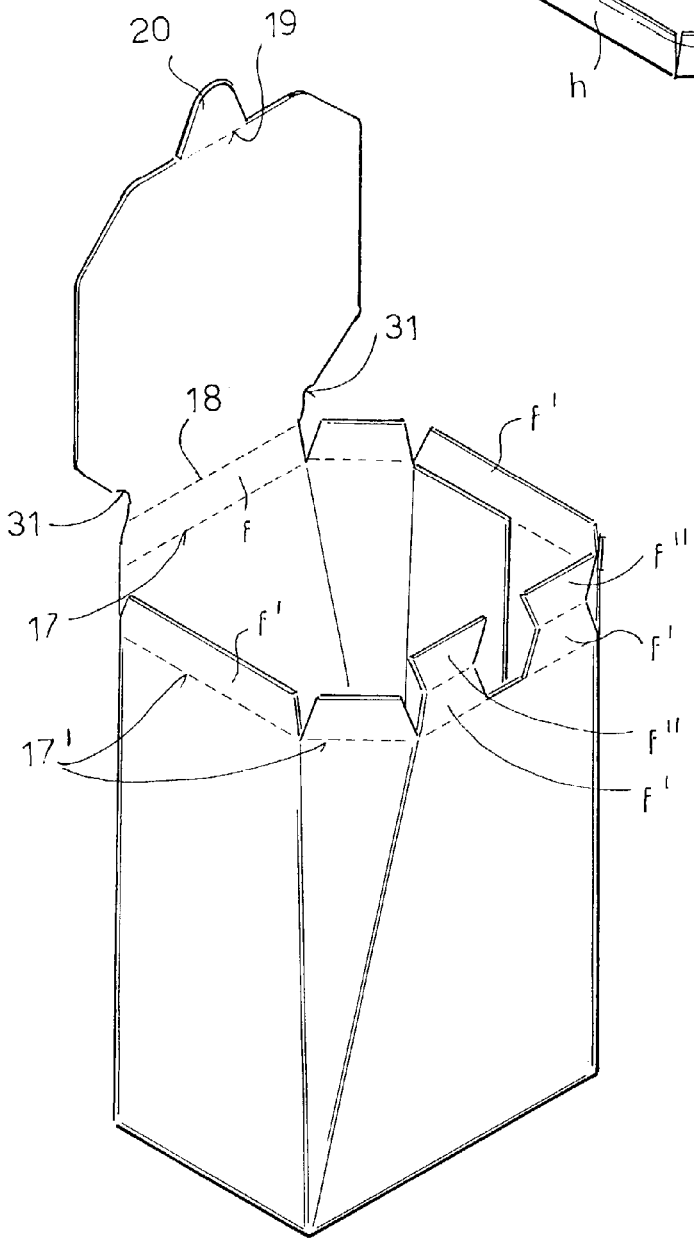
FIG. 5

CARDBOARD CONTAINER FOR SOLID, GRANULAR OR POSSIBLY PASTY PRODUCTS, AND MANUFACTURING METHOD THEREOF

DESCRIPTION

The present invention refers to a cardboard container for solid, granular, or possibly fluid or pasty products and the like, and a production method thereof.

Although in the description that follows, reference will be made primarily to a cardboard container, it is to be understood that the material used to form the container may be a multi-layer material, comprising a layer of cardboard, such as to give the container a certain rigidity, and possibly other layers of sheet material.

Normally, containers of the type to which the invention refers are ordinary cardboard boxes, obtained by successive folding and gluing of a flat blank, so as to obtain a substantially parallelepiped shape of the desired size.

Of course, besides the classic parallelepiped shape, other shapes have been proposed, depending upon the particular use for which the container is intended.

These box-type cardboard containers have various drawbacks, which go from imperfect sealing of the container, impossibility of reclosure, or unreliable reclosure of the container in the event of partial use of the product, to loss of or decrease in the rigidity of the container if opening thereof involves substantially the entire upper surface.

Said box-type cardboard containers do not lend themselves to containing products in a viscous, pasty or fluid state.

One object of the invention is to provide a cardboard container which is perfectly sealed before use, and which is easily opened, forming a wide opening for removal of the product that involves substantially the entire upper surface of the container.

Another object of the invention is to provide a cardboard container provided with a snap reclosure cover, which allows the product to be preserved in the event of partial use.

Yet another object of the invention is to provide such a container which maintains good rigidity even after opening.

Yet another object of the invention is to provide such a cardboard container which can be adapted to contain products in a pasty, viscous or fluid state.

Another, but not the last, object of the invention is to provide such a container that is simple and economical to make.

The container according to the invention has the characteristics of appended independent claim 1.

Advantageous embodiments of the invention are apparent from the dependent claims.

Essentially, the container according to the invention is obtained from two cardboards blanks suitable to form the body of the container and the top closure wall, respectively.

In particular, the blank of the container body has fold and crease lines which cause the container, once erected, to take on a slightly conical shape, which starts from a rectangular base and ends with an octagonal shaped open top wall, wider than the base.

The open container body thus formed has, at its upper edge, a series of tongues or flaps which, after the container has been filled with the product, are folded inwardly, to embrace corresponding flaps of the blank forming the top closure wall of the container.

A line of pre-cutting is then formed in said top closure wall of the container, to facilitate opening of the container.

The blank forming the container body advantageously has, at one of its edges, an octagonal extension, able to form a reclosure cover for the container.

The container thus formed, in one embodiment thereof, can be made hermetic, for containing products in a pasty or viscous state, such as yoghurt and the like, or even liquid products.

For this purpose, there is applied to the blank able to form the body of the container, on the surface adapted to form the inner surface of the container, a sheet of plastic material, such that after folding of the blank to form the body of the container, it covers the entire inside surface thereof, making it hermetic, that is watertight.

Likewise, the blank forming the top closure wall of the container has on the inside a thin sheet of aluminium, which ensures the upper seal of the closed container.

Otherwise, the container is similar to that previously described, opening also taking place in a similar manner along the pre-cut line, which also produces perfect rupture of the thin aluminium sheet.

Further characteristics of the invention will be made clearer by the detailed description that follows, referring to purely exemplary and therefore non-limiting embodiments thereof, illustrated in the appended drawings, in which:

FIG. 4 is a plan view of a blank from which the top closure wall of the container of FIGS. 1 and 2 is obtained;

FIG. 5 is an axonometric view of the container body, in an upright position, obtained by folding and gluing of the blank f FIG. 3, before filling with the product;

FIG. 6 is a diagrammatic axonometric view of the blank of FIG. 4, shown with the peripheral flaps folded upward, in position to be inserted in the body of the open container of FIG. 5, to form the top closure wall of the container;

FIGS. 8 and 9 are plan views of the blanks of FIGS. 3 and 4, respectively, for formation of a hermetic, watertight container.

Figure 1:
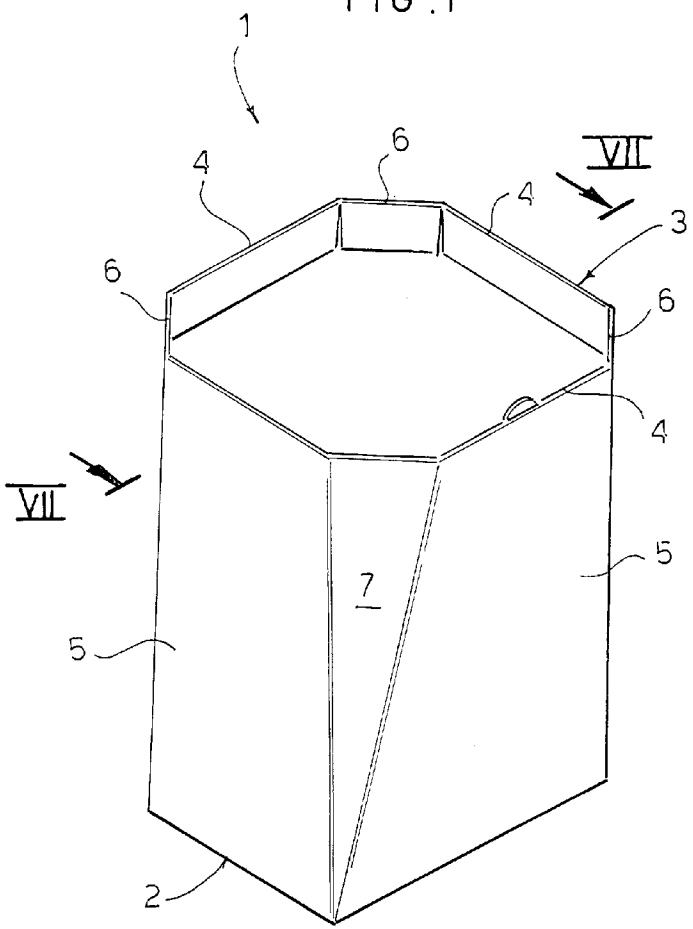
FIG. 1 is an axonometric view of a container according to the invention, with the reclosure cover lowered.
Figure 2:
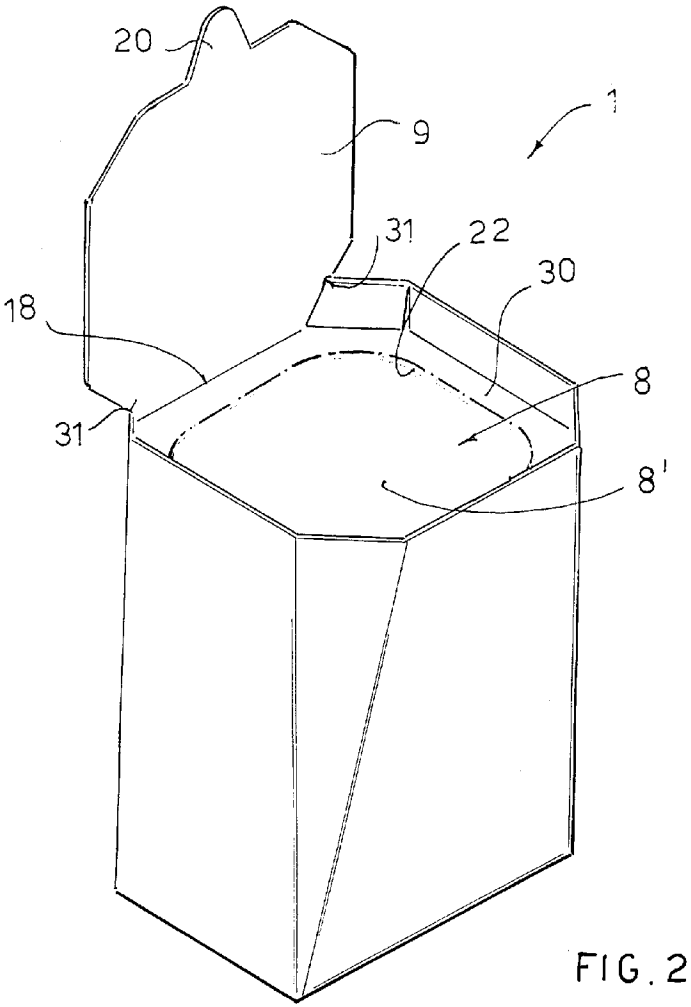
FIG. 2 is an axonometric view of the container of FIG. 1 with the reclosure cover raised.

With reference to said figures, and for now in particular to FIGS. 1 and 2, the cardboard container according to the invention has been indicated as a whole with reference numeral 1.

In a first embodiment, which will now be described, the container 1 is used particularly for containing solid, granular or even powdery products. Purely by way of example, sweets, chocolates, animal foods, soap powders and the like can be cited as products for which the container is intended.

As can be seen in FIGS. 1 and 2, the container 1 has a rectangular base 2 and an octagonal top 3, widened with respect to the base, so as to determine a certain conicity of the container.

In particular, the octagonal top 3 of the container has four larger sides 4, opposed two by two, corresponding to the four side walls 5 of the container, separated by an equal number of smaller sides 6, disposed at the four corners of the container, and obtained by means of respective triangular blunted edges 7 of said corners, which start from zero at the base 2 of the container, and reach the maximum width at the top thereof.

As can be seen better in FIG. 2, the container 1 has a top closure wall 8 and a reclosure cover 9, elements which will be better described further on.

The elements making up the container 1 according to the invention, and the way in which it is formed are described with reference now to FIGS. 3 to 7.

Figure 3:
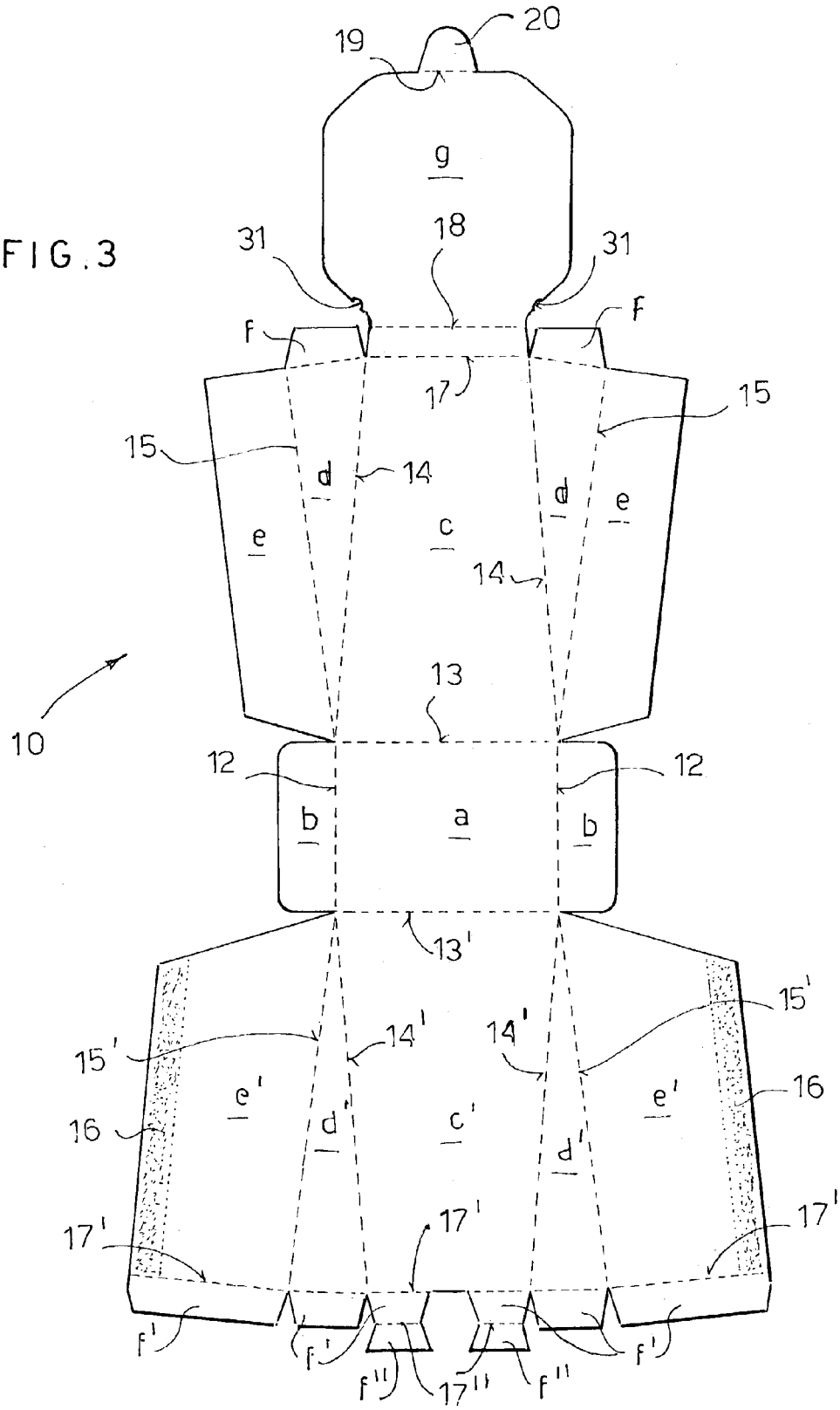
FIG. 3 is a plan view of a blank from which the body and the reclosure cover of the container of FIGS. 1 and 2 are obtained.

The container 1 is obtained substantially from two blanks 10 and 11, shown in a plan view in FIGS. 3 and 4, respectively, the first able to form the body of the container, shown in the erect position in FIG. 5, and the second able to form the top closure wall 8 of the container, shown in FIG. 6 during assembly on the body 5.

In said figures, the dashed lines indicate the crease and fold lines, along which the various parts of the blank are folded to obtain the container, as will now be better described.

The blank 10 of FIG. 3 comprises a central rectangular part a intended to form the base 2 of the container 1.

At the two sides of the rectangle a there are attached, by means of respective folding lines 12, corresponding tongues b, which are folded inwardly by about 90°, during formation of the container.

At the other two sides of the rectangle a there are attached, by means of respective folding lines 13, 13', isosceles trapezium-shaped portions c, c', intended to form the rear wall and the front wall of the container 1, respectively, as shown in FIGS. 1 and 2.

Respective pairs of triangular portions d, d', with their vertexes disposed at the vertexes of the central rectangle a, are joined, by means of crease lines 14, 14', to the oblique sides of the trapezoid portions c, c', said triangular portions d, d' being able to determine said blunted corners 7 of the container 1. Further portions e, e' shaped substantially as a right-angled trapezium, with the acute angles of the trapezium facing towards the central rectangular portion a are then joined to the triangular portions d, d', again along crease lines 15, 15'.

The trapezoid portions or wings e are narrower than the corresponding wings e' and are destined to be disposed inside the latter, to form together two side walls, right and left, of the container 1. On the outer edge of the wings e' there are provided respective strips of adhesive 16, to block the superimposed wings e, e' firmly. From the upper and lower outermost edges of portions c, d and c', d', e' respectively, there protrude respective trapezoid flaps f, f', destined to be folded on the inside of the container along respective fold lines 17, 17', to block the top closure wall 8 of the container, as will be better described below.

In particular, two trapezoid flaps f', spaced apart from each other and slightly smaller in height than the others, protrude from the isosceles trapezium-shaped portion c', said two flaps f' extending with two other symmetrical flaps f", superimposable thereon after folding about respective fold lines 17".

Furthermore, there is connected to the flap f of the isosceles trapezium-shaped portion c, by means of a fold line 18, an octagonal portion g, intended to form the reclosure cover 9 of the container, provided with a pull tab 20 that can oscillate around a fold line 19.

The blank 11 of FIG. 4, destined to form the top closure wall 8 of the container, is octagonal in shape in a plan view, as described earlier, and has rectangular flaps h, connected by means of respective fold lines 21 to each side of the octagon.

Said flaps h are destined to be folded about 90° and be disposed beneath the flaps f, f' of the blank 10 for closure of the container, as will be described better below.

As can be seen in FIG. 4, the blank 11 has a pre-cut line 22 which extends substantially parallel to the octagonal perimeter of the blank, following a rounded path and ending at the front in a crescent 23, so that by pressing on the portion 24 in front of the crescent 23, an opening is formed through which the central part or disk 8' of the top wall 8 of the container can be gripped to remove it along the pre-cut line 22, and form the opening of the container.

Formation of the container 1 with the blanks 10 and 11 of FIGS. 3 and 4 will now be described.

Starting from the blank 10, keeping the base a fixed, the two side tongues b are erected, disposing them internally, and then the isosceles trapezium-shaped portions c, c' are erected with the other portions d, e and d', e' connected thereto. The latter are then made to rotate around the respective crease and fold lines 14, 15, 14', 15', so that the wings e' are partially superimposed on the corresponding wings e, defining the erected container, open at the top, shown in FIG. 5. The strips of glue or heat-bonding adhesive 16 applied to the wings e' ensure fixing to the wings beneath and thus maintenance of the shape of the container body as shown in FIG. 5.

During formation of the container, the eight creases 14, 15, 14' 15', diverging from the bottom upward, determine the conicity of the container and give the top thereof the above mentioned octagonal shape.

The container body can easily be erected mechanically, by means of an inner mandrel which holds the base a fixed, whereon hinged mechanical systems erect the various portions of the blank 10 to form the container body.

The open container shown in FIG. 5 is filled with product before closure, which takes place in the following manner.

The peripheral flaps h of the blank 11 of FIG. 4 are folded upwardly about 90°, to take on the tray configuration 25 illustrated in FIG. 6.

The tray-shaped blank 25 of FIG. 6 is inserted in the open container of FIG. 5, through the open upper part thereof, and is disposed so that the upper edge 26 of the folded flaps h is disposed at the level of the fold lines 17, 17' of the corresponding flaps f, f' of the open container of FIG. 5.

In this manner, by folding the flaps f, f' inward on the corresponding flaps h, after application of a layer of glue, upper sealing of the container is obtained, as shown in FIG. 2. Naturally, the pairs of front flaps f', f" of the open container of FIG. 5 are folded on themselves before being folded on the underlying flap h of the tray-shaped blank 25.

Lastly, the cover 9 is lowered onto the top closure wall 8, as shown in FIG. 1.

Figure 7:
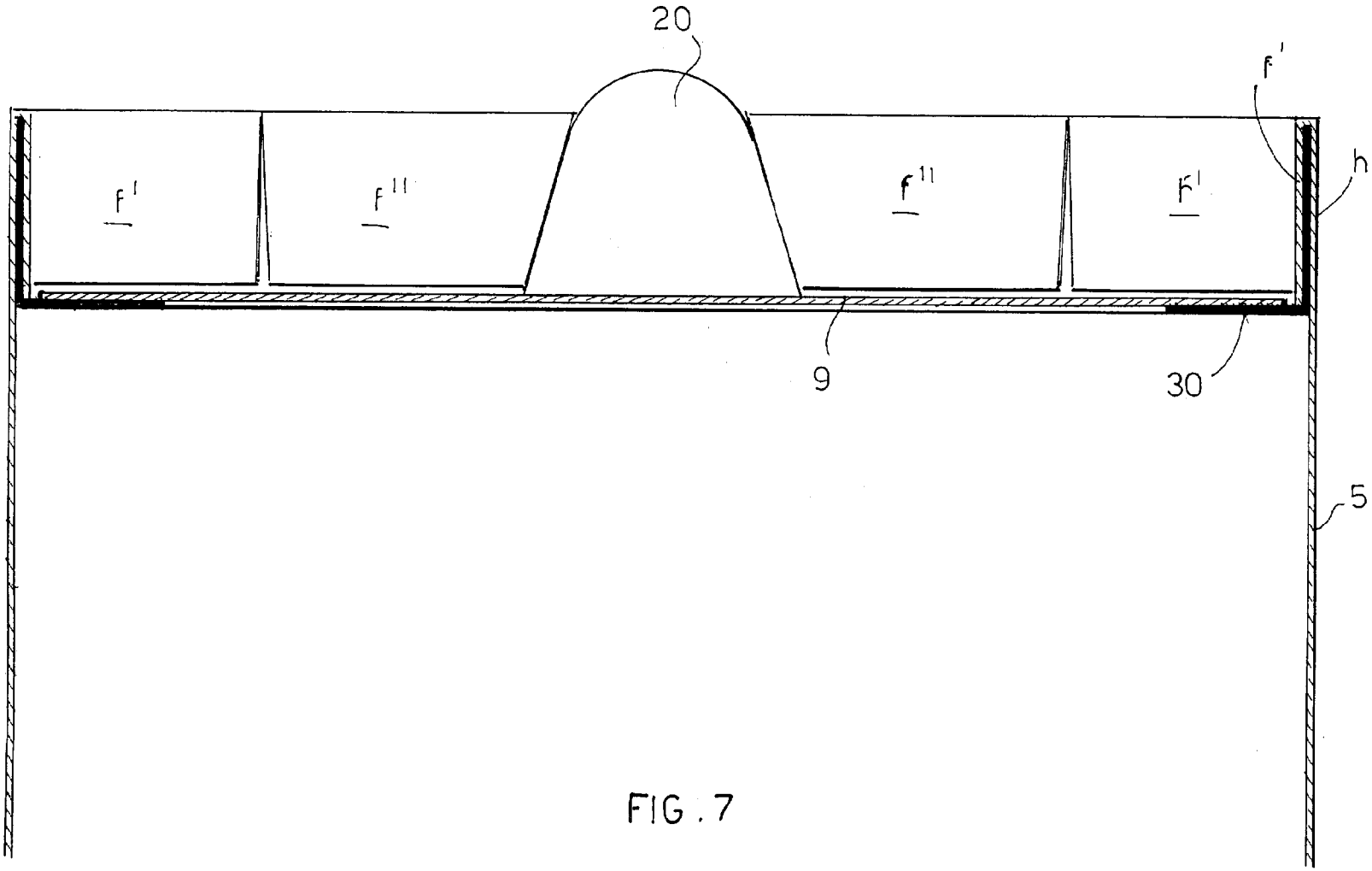
FIG. 7 is a section taken along the plane of section VII—VII of FIG. 1, showing snap reclosure of the cover.

It should be noted that in said lowered position, as shown in the section in FIG. 7, the cover 9 is positioned below said pairs of front, superimposed flaps f', f", which are slightly shorter than the other flaps f, f', and by protruding further than the others inside the perimeter of the container for the double thickness, prevent the cover from lifting spontaneously. In practice, when the cover is lowered it snaps shut and is held in the closure position by said superimposed flaps f', f".

Raising of the cover 9 is facilitated by the pull tab 20 which is housed in the empty space defined by said pairs of superimposed flaps f', f", and which protrudes slightly beyond the upper outline of the container 1.

The first opening of the container is facilitated by the pre-cut line 22 formed on the top closure wall 8.

In fact, by exerting pressure downward with one finger on the hemispherical part 24 in front of the crescent-shaped joining line 23 of the cut 22, an opening is formed through which it is possible to grip the disk 8' and remove it easily by simply pulling upward, causing detachment thereof along the cut line 22.

It should be noted that the cut line 22–23 can have a different course from that illustrated purely by way of example in the appended figures. In theory, it could extend exactly along the inner perimeter of the container.

In practice, however, it is preferred for removal of the disk 8' to leave an edge 30, suitably joined in the corners, that allows the top opening of the container to be stiffened.

The function of this edge 30 is also that of acting as an abutment surface for the reclosure cover 9 which comes to rest thereon after the disk 8' has been removed.

As shown diagrammatically in FIGS. 1, 2 and 5, two small notches 31, formed on the sloping sides of the octagonal cover 9 joined to the fold line 18, allow the cover 9 to be blocked in the open position, as shown in FIG. 2, hooking on to the upper edge of the container.

Reclosure of the cover 9 takes place by lowering thereof, as previously described.

Figure 8:
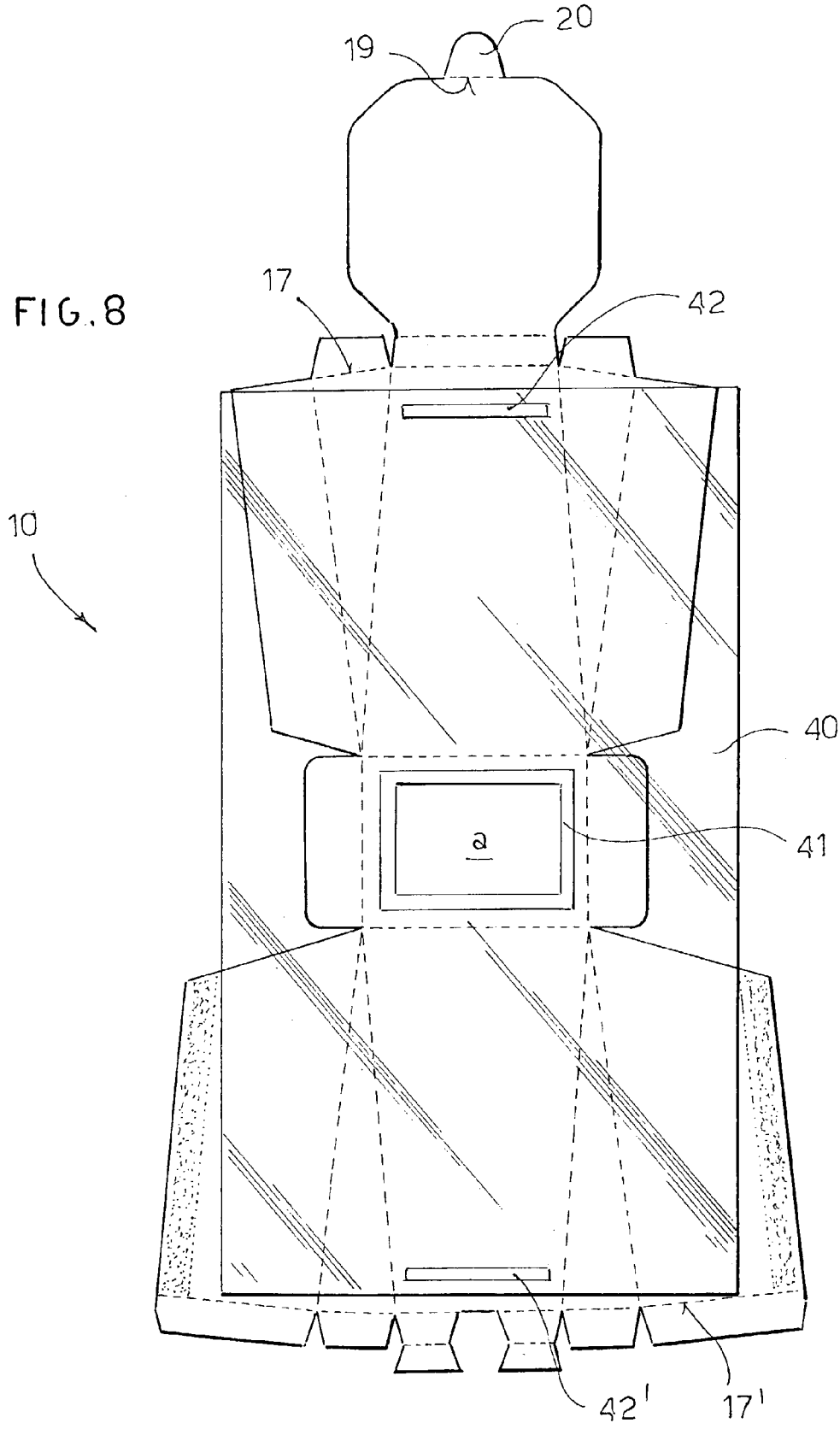

FIGS. 8 and 9 show the same blanks 10 and 11 as FIGS. 3 and 4, respectively, according to an embodiment of the container of the invention particularly suitable for containing products in a liquid, paste or cream state.

According to said embodiment, a lining film 40 of single- or multi-layer plastic material, preferably heat-bondable on both sides, is applied to the blank 10.

The film 40 is substantially rectangular in shape and of such a size that its length reaches to the fold lines 17, 17' of the flaps f, f', whereas its width is such as to allow the film, in the established conicity of the container, to be superimposed so that hermetic closure can then be achieved by heat bonding.

As shown diagrammatically in FIG. 8, the film 40 is constrained to the blank 10 by means of a track of gluing or sealing 41, which extends along a rectangle parallel to the perimeter of the base a, and by means of two strips of gluing or sealing 42, 42' disposed near the top of said trapezoid portions c, c'.

Naturally the arrangement of the above mentioned areas of gluing or sealing 41, 42, 42' is purely by way of example.

A typical structure of the lining film could be PE/PET/PE, wherein the PET film acts as temperature-resistant material conferring a certain rigidity whilst the two PE films form the heat-sealable part on the two surfaces.

The PET film can be metallized to give even greater impermeability.

The container body is formed as described in the previous embodiment, obtaining a container open at the top, with an inner lining 40, which can be filled with the fluid product and closed with a cover, which must also have characteristics of impermeability, and at the same time must be able to allow easy opening along the above mentioned cut line 22.

For this purpose, as shown diagrammatically in FIG. 9, coupled to the blank by means of adhesive or welding o sealing is a thin aluminium sheet 50 (9, 10 micron), which covers the entire peripheral outline of the blank 11, including the empty spaces between successive flaps h, indicated by 51.

In this manner, when the flaps h are folded to be inserted beneath the corresponding flaps f, f' of the container, a shaped surface without breaks in continuity is formed.

Fixing of the closure wall 8 to the container body takes place as in the previous embodiment, by sealing the flaps f, f', heat sealable on the inside, to the underlying flaps h and in this case also by bonding the aluminium layer 50 to the underlying lining film 40 so as to produce a single hermetically sealed whole.

The lining film 40 is in turn sealed to the inner part of the container with the dual function of further stiffening the mouth of the container.

For opening of the container it is sufficient, as in the previous case, to exert a simple pressure on the hemispherical portion 24, to cause yielding and breaking of the cardboard along the cut line, and thus allow removal of the disk 8'.

In this phase, the thin layer of aluminium 50 faithfully follows breaking along the cut line 22.

It can thus be seen that the blanks of FIGS. 8 and 9 allow a perfectly hermetic container to be formed, that is simple and economical to make, unlike the solutions existing on the market which are very sophisticated, wherein the structure of the material is a single whole of components in a plurality of layers such as to make the cardboard impermeable.

The hermetic container solution according to the invention also lends itself to easy recycling, in that the lining film 40 of plastic material can if necessary be detached from the cardboard 10, allowing separate collection.

From the aforegoing, the advantages of the cardboard container according to the invention are obvious; however, it is not limited to the particular embodiments previously described and illustrated in the appended drawings, but is amenable to numerous modifications of detail, within the reach of a person skilled in the art, without thereby departing from the scope of the invention, as set forth in the appended claims.

The invention claimed is:

1. A cardboard container having a substantially box-type shaped body, open at a top, and a top closure wall (8), characterised in that said body and said top closure wall are formed from two respective blanks (10, 11), said top closure wall (8) being disposed inside the container body, at a certain distance from an upper edge (3) thereof, and being provided with a pre-cut line (22, 23) able to facilitate detachment of a disk (8'), to form an opening for access to the container, characterised in that it further comprises a reclosure cover (9), openable hingedly around one of a plurality of folded flaps (f, f') of the upper edge (3) of the container are being disposed, in a closed position, on said top closure wall (8) and on said peripheral edge (30), once said disk (8') for reclosing of the container has been removed, and characterised in that reclosure of said cover (9) takes place by snap closure, the front edge of said cover being disposed, with slight forcing, beneath at least one flap (f, f') of said upper edge (3) of the container, said at least one flap being shorter and thicker than the other flaps (f, f').

2. A container according to claim 1, characterised in that said top closure wall (8) has a plurality of peripheral flaps (h) folded upwardly at about 90° so as to be disposed against the corresponding inner walls of the container body, which has at an upper peripheral edge (3) corresponding counterflaps (f, f') which, folded inwardly, are superimposed on said flaps (h) of the closure wall, blocking it in position by means of glue or adhesive.

3. A container according to claim 1, characterized in that said container (1) rises from a rectangular base (2) with a predetermined conicity, widening towards the upper part, where said container has an octagonal top (3) with four larger sides (4), coinciding with the four substantially vertical peripheral walls (5) of the container, and four smaller sides (6), coinciding with blunted corners (7) of the container.

4. A container according to claim 1, characterised in that said pre-cut line (22, 23) is shaped so as to leave on said top closure wall (8), after removal of said disk (8'), an edge (30) extending at least partially along the perimeter of the container (1), to stiffen the mouth of the container.

5. A container according to claim 1, characterised in that said reclosure cover (9) has a pull tab (20) protruding beyond said upper edge (3) of the container, in the closure position.

6. A container according to claim 1, characterised in that a pull tab (20) of the cover (8) is disposed, in the closure position, in the empty space between two said flaps (f, f').

7. A container according to claim 1, characterised in that said cover (9) has, on two inclined sides thereof adjacent the hinging side, two notches (31) able to hook on to the upper edge (3) of the container, so that the cover is held blocked in the opening position.

8. A container according to claim 1, characterised in that disposed inside said container body is a film (40), fixed at points or along lines to said blank (10) and sized to reach to said upper edge (3) of the container, being disposed beneath folded flaps (f, f'), and to cover an entire inside peripheral surface of the container, a thin aluminium sheet (50) being applied internally to said top closure wall (8), such that following fixing of said top closure wall (8) to the body of the container by folding of said flaps (h) and sealing or gluing along the upper peripheral edge of the container, a single hermetically sealed whole is formed.

9. A container according to claim 8, wherein said lining film (40) is a multilayer 30 plastic film, heat-sealable on both sides.

10. A method for production of a cardboard container, particularly for solid granular or powder products, obtained starting from first and second blanks (10), (11), according to claim 12, said method comprising the following stages:

for said first blank (1), inward folding of said tongues (b) about the respective fold lines (12), upward folding of said isosceles trapezium portions (c, c') around said respective fold lines (13, 13').

inward rotation of said triangular portions, and said first and second pairs of trapezium-shaped portions (d, e, d', e'), about the crease lines (14, 15, 14', 15'), respectively, partial superimposition of said second pair of trapezium-shaped portions (e', e') and said first pair of trapezium-shaped portions (e, e) and fixing by said strips (16) of glue or heat-sealing adhesive, so as to obtain a container body open at the top, filling of the open container body with the relative product, and for said second blank (11), upward folding at about 90° of said flaps (h) of said blank (11), having pre-cut lines (22–23), insertion of the blank (11) with the flaps (h) facing upwards into the open container body disposing it as such a level that its upper edge coincides with the fold lines (17, 17') of the flaps (f, f') of the blank (10), and inward folding of said flaps (f, f') and gluing thereof to the corresponding flaps (h) of the blank (11), whereby said cover (9) is lowerable onto said top closure wall (8).

11. A method according to claim 10, for production of a container particularly suitable for containing fluid products, characterised in that before folding, a plastic film (40), heat-sealable on both sides, is applied to said blank (10) and a thin layer of aluminium (50) is closely applied to said blank (11) by gluing or heat sealing.

12. A blank (10) for production of a container body for containing products, comprising:

a central rectangle (a) defining said container base (2), two opposed tongues (b) inwardly foldable about respective fold lines (12) coinciding with two opposite sides of the of the rectangle (a), two portions each shaped as an isosceles trapezium (c, c') foldable about two other sides (13, 13') of the rectangle (a), to form rear and front walls, respectively, of the container (1)

two pairs of triangular portions (d, d, d', d') respectively adjacent said isosceles trapezium portions (c, c') and joined thereto by means of respective crease lines (14, 14'), said triangular portions (d, d') having vertices coinciding with corresponding vertices of said rectangle (a), being able to form said blunted corners (7) of the container (1), first and second pairs of connecting portions, each portion in each of said first pair and said second pair being shaped as a trapezium (e, e, e', e'), respectively adjacent said triangular portions (d, d, d', d'), and joined thereto by respective crease lines (15, 15'), the trapesium-shape portions in said second pair (e', e') being wider than the trapezium-shape portions in said first pair (e, e') and being provided on the respective outer edges with a strip of glue or heat-sealable adhesive (16, 16'), for fixing to the corresponding trapezium-shaped portions in said first pair (e and e), to define, by superimposition of said first and second trapezium-shaped portions (e, e'), the right and left side-walls of the container body and the closure thereof, a plurality of flaps (f, f'), sealable on the inside, substantially shaped as isosceles trapezium, protruding respectively from said isosceles trapezium and triangular portions (c, d) and from said isosceles trapezium, triangular and second pair of trapezium-shaped portions (c', d', e'), octagonal portion (g) connected by means of a fold line (18), to one of said flaps (f, f'), to form said re-closure cover.

13. A blank according to claim 12 for production of a container body particularly suitable for containing products in a fluid state, characterised in that said blank further comprises a lining film (40) of plastic material, fixed at points or along lines to the blank (10), and sized as to come level with folding bases (17, 17') of said flaps (f, f') respectively, and to involve an entire peripheral surface of the container.

14. A blank according to claim 13, characterised in that said lining film (40) is heatsealable on both sides and is fixed to the blank (10) along a rectangular track (41) which involves said base (a) and two strips (42, 42') disposed near the free ends of said isosceles triangle-shaped portions (c, c'), respectively.

* * * * *